US005533722A

United States Patent [19]

Lu

[11] Patent Number: 5,533,722

[45] Date of Patent: Jul. 9, 1996

[54] TABLE TENNIS TRAINING SYSTEM

[76] Inventor: Tzu-Hao Lu, No. 45-20, Tzu Yu Road, Yu Che Li, Ma Do Chen, Tainan Hsien, Taiwan

[21] Appl. No.: 251,214

[22] Filed: May 31, 1994

[51] Int. Cl.[6] ..... A63B 39/00

[52] U.S. Cl. ..... 273/30; 273/26 D; 273/29 A

[58] Field of Search ..... 273/30, 26 D; 124/51 R, 6, 51 A, 41 R

[56] References Cited

U.S. PATENT DOCUMENTS

| | | | |
|---|---|---|---|
| 3,999,754 | 12/1976 | Krzysztofiak | 273/30 |
| 4,002,336 | 1/1977 | Beaver | 273/30 |
| 4,077,386 | 3/1978 | Berliner | 273/30 |
| 4,559,918 | 12/1985 | Ballerin | 273/30 |
| 4,846,269 | 12/1989 | Marocco | 273/30 |

*Primary Examiner*—Theatrice Brown
*Attorney, Agent, or Firm*—Varndell Legal Group

[57] ABSTRACT

A table tennis training system including a pitching machine and a cage spaced around the pitching machine at the back, the pitching machine includes a machine base defining a vertical ball channel, a shooting box pivotally mounted on the machine base at the top and defining a storage chamber. A blowing fan is arranged to blow ping-pong balls from the ball channel into the storage chamber. A ball feeding mechanism guides table tennis balls from the storage chamber to a firing position one after another, and a pitching mechanism is moved between a left limit position and a right limit position and controlled to throw the table tennis ball from the firing position. The pitching mechanism includes two rotary members and two unidirectional motors separately controlled to turn the rotary members for driving the table tennis ball from the firing position out of the shooting box.

2 Claims, 10 Drawing Sheets

TABLE TENNIS TRAINING SYSTEM

BACKGROUND AND SUMMARY OF THE INVENTION

The present invention relates to a table tennis training system which can be controlled to change the position of the pitching mechanism thereof and to drive the pitching mechanism in throwing out ping-pong balls one after another at a predetermined frequency at different speeds.

When learning or practicing the game of table tennis, one must have to coach to teach or a companion to play with. Without an opponent, no one can play the game of table tennis. There are training machines disclosed for learning or practicing the game of table tennis. However, these table tennis training machines cannot provide breaking pitches variably.

According to one aspect of the present invention, the table tennis training ball system consists of a pitching machine controlled to throw out table tennis balls one after another at a predetermined frequency, and a cage spaced around the pitching machine at the back to collect table tennis balls been hit back by the player. According to another aspect of the present invention, the pitching machine comprises a machine base defining a vertical ball channel, a shooting box pivotally mounted on the machine base at the top and defining a storage chamber, a blowing fan to blow table tennis balls from the ball channel into the storage chamber of the shooting box. The shooting box also has a ball feeding mechanism to guide table tennis balls from the storage chamber to a firing position one after another, and a pitching mechanism moved between a left limit position and a right limit position and controlled to throw the table tennis ball from the firing position, the pitching mechanism including two rotary members and two unidirectional motors separately controlled to turn the rotary members in driving the table tennis ball from the firing position out of the pitching box. According to still another aspect of the present invention, the rotary members can be turned alternatively or simultaneous at same speed or different speeds so as to perform a fireball or breaking pitch. According to still another aspect of the present invention, the angular position of the pitching box on the machine base can be adjusted horizontally as well as vertically.

DETAILED DESCRIPTION OF THE PREFERRED EMBODIMENT

A table tennis training system in accordance with the present invention is generally comprised of a pitching machine and a cage.

Figure 3:
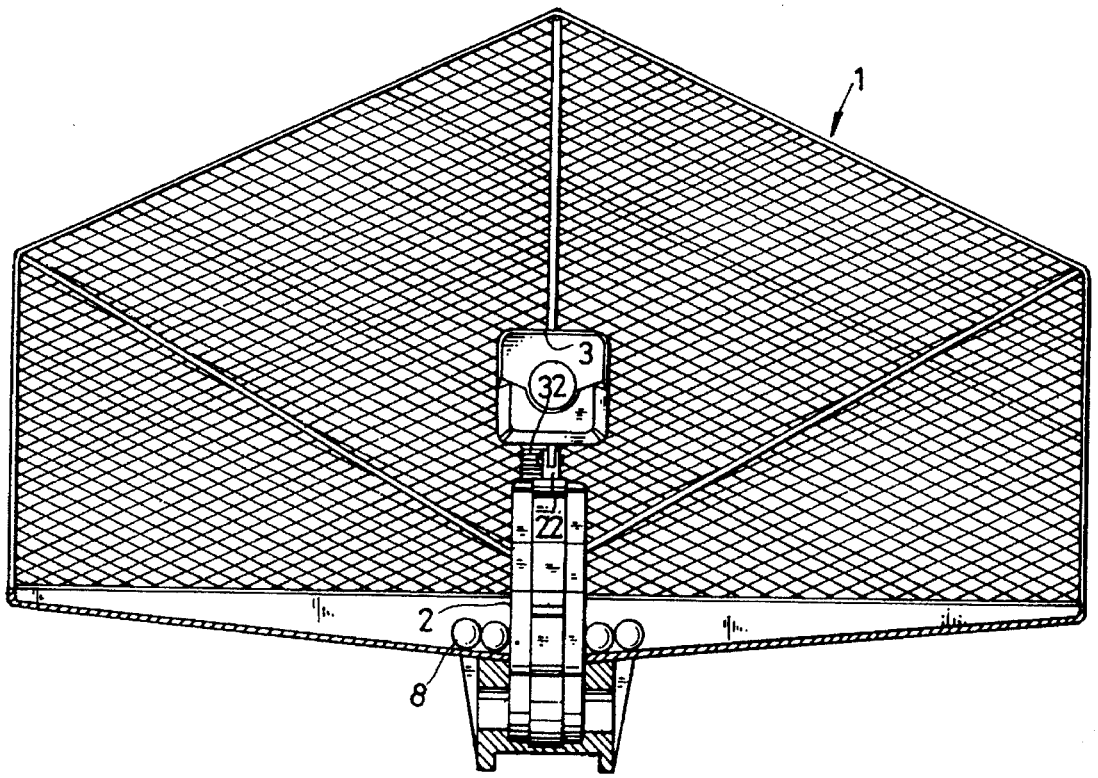
FIG. 3 is a front view of a table tennis training system according to the present invention.
Figure 4:
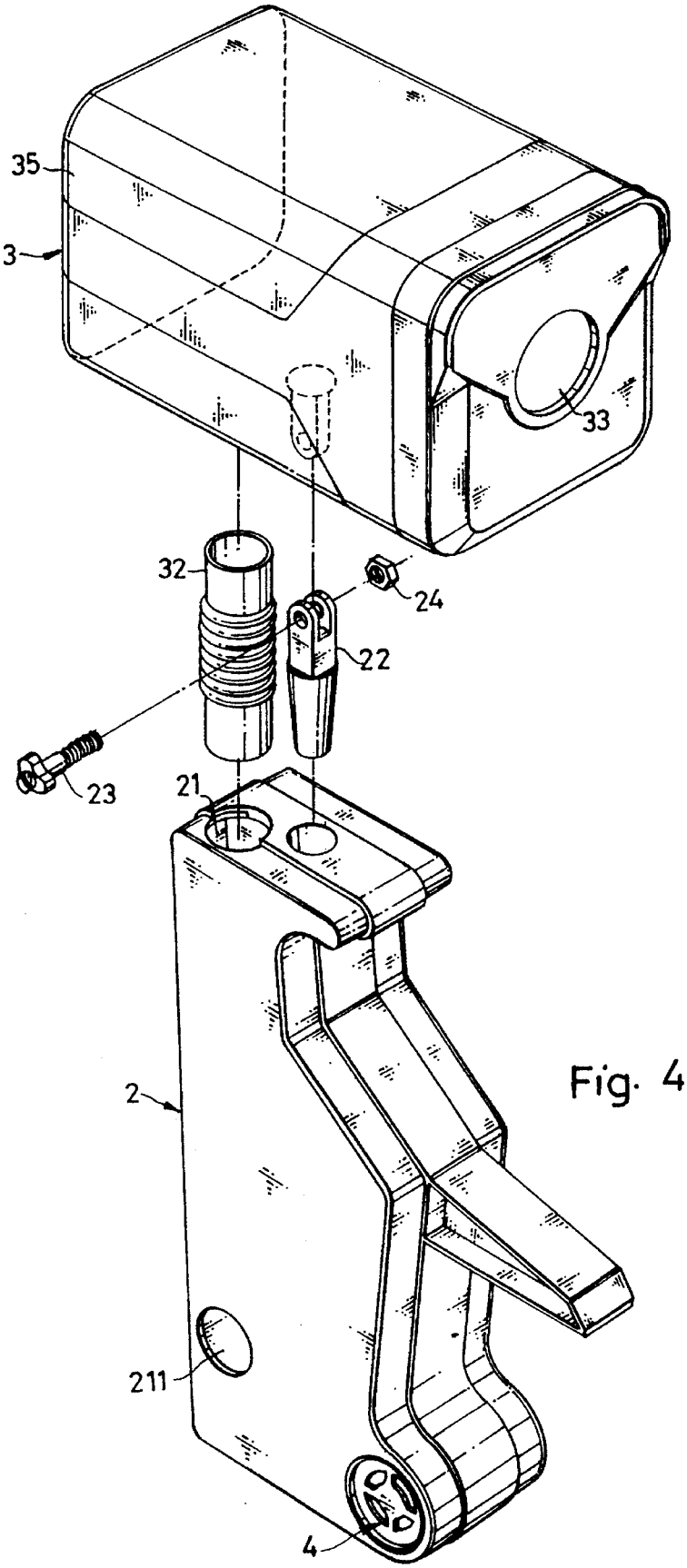
FIG. 4 is a dismantled view of the shooting box and machine base of the shooting machine shown in FIG. 1.
Figure 5:
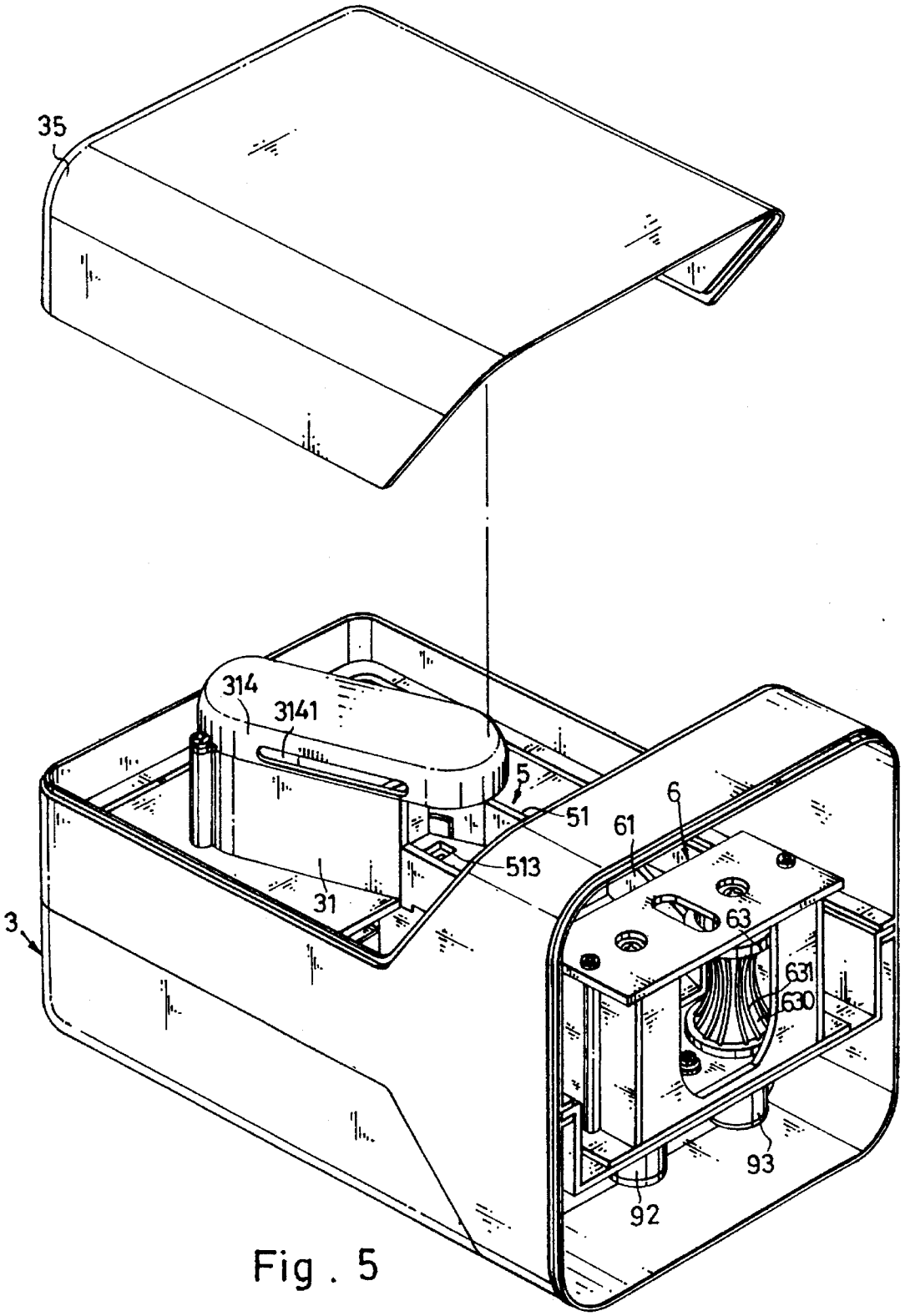
FIG. 5 shows the shooting box of FIG. 4 opened.
Figure 6:
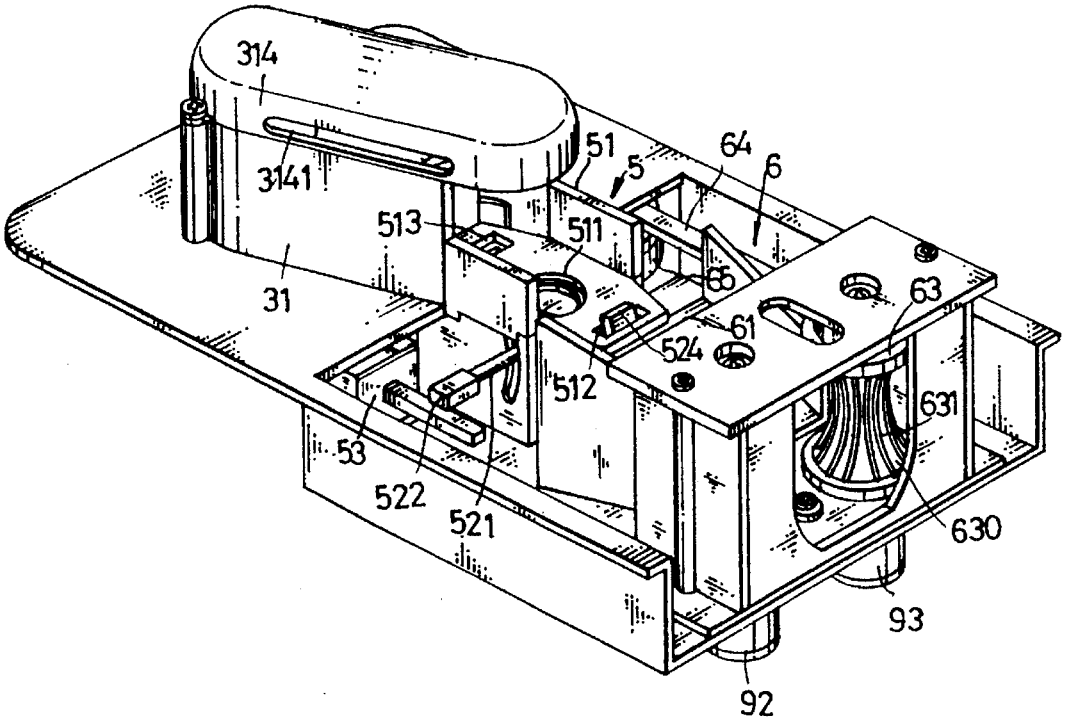
FIG. 6 shows the internal arrangement of the pitching box according to the present invention.

Referring to FIG. 3, the cage, referenced by 1, is disposed around the pitching machine to collect table tennis balls which were driven out of the pitching machine and hit back by the player, permitting the collected table tennis balls to be automatically guided back into the pitching machine in good order.

Figure 1:
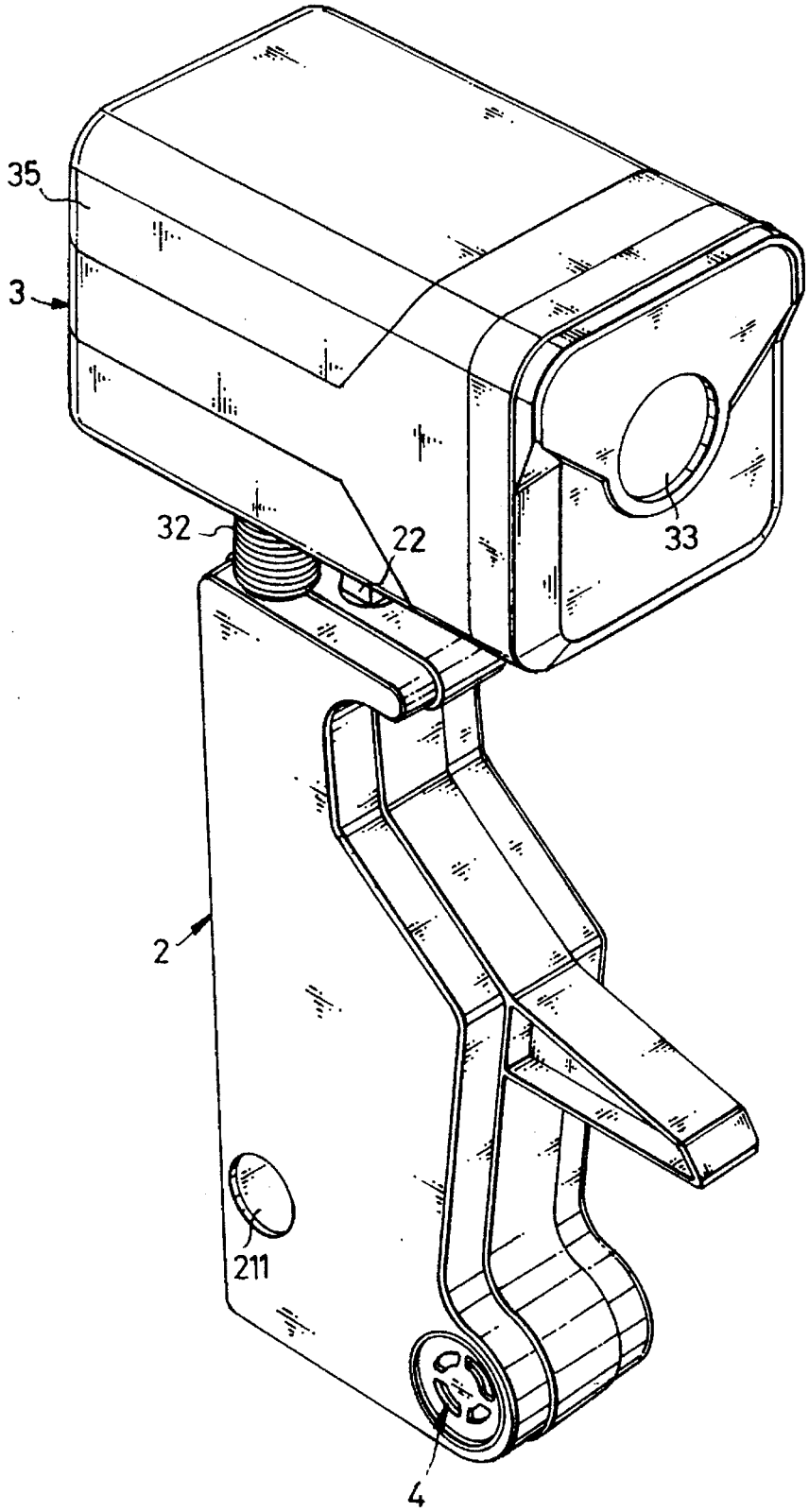
FIG. 1 is an elevational view of a pitching machine according to the present invention.
Figure 2A:
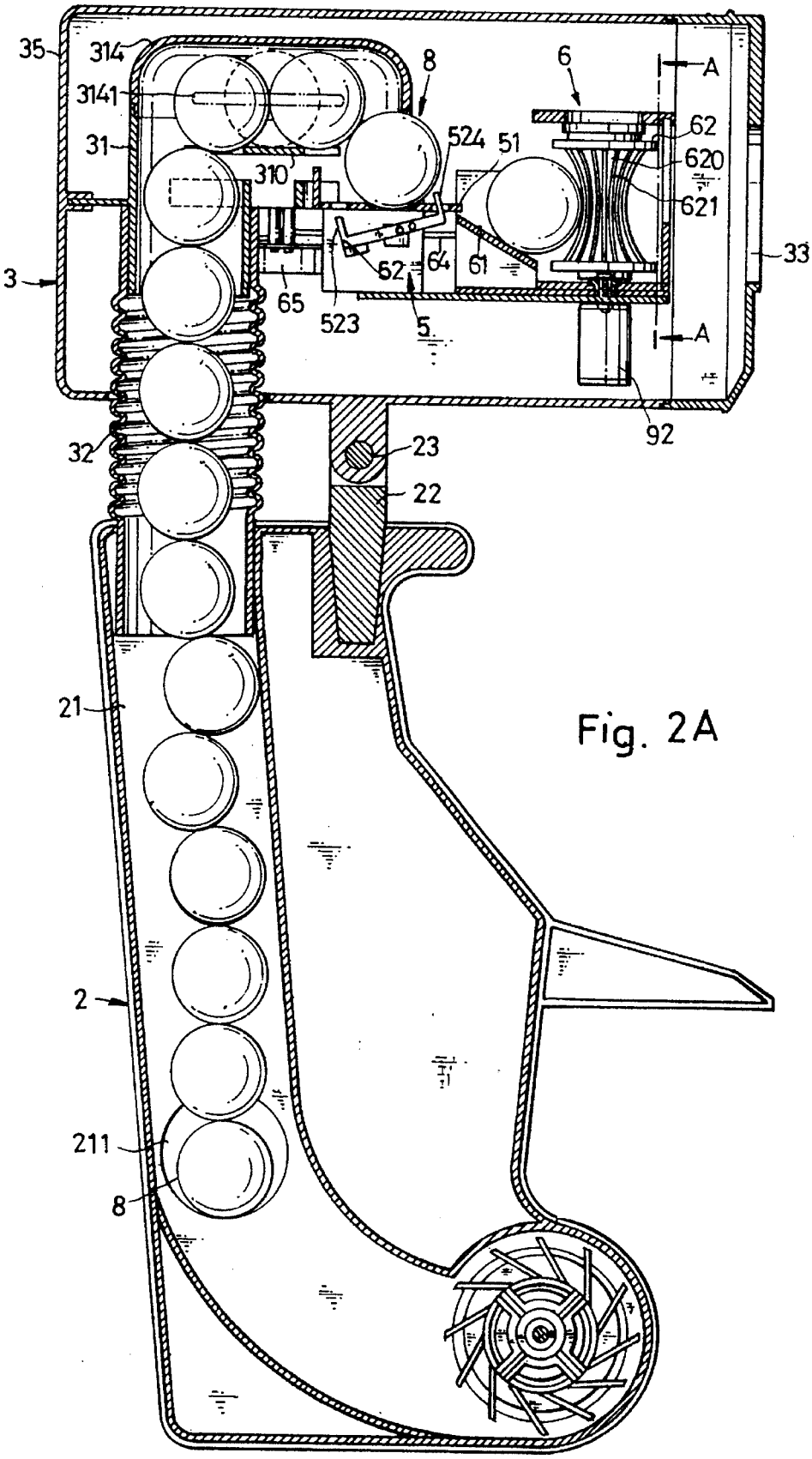
FIG. 2A is a longitudinal view in section of the pitching machine shown in FIG. 1.
Figure 2B:
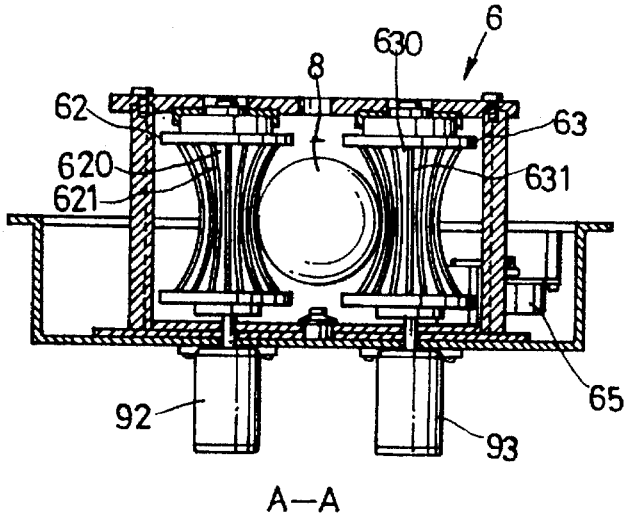
FIG. 2B is a sectional view taken on line A—A of FIG. 2A.

Referring to FIGS. 1 and 2A, the pitching machine comprises a machine base 2, a shooting box 3 mounted on the machine base 2 at the top, a ball feeding mechanism 5 mounted inside the shooting box 3, a pitching mechanism 6 mounted inside the shooting box 3 in front of the ball feeding mechanism 5, and a control circuit (not shown) .

The machine base 2 comprises an upright support 22 at the top pivotally connected to the shooting box 3 at the bottom by a pivot bolt 23 and a nut 24, a vertical ball channel 21, a blowing fan 4 installed in the vertical ball channel 21 at the bottom, through which the table tennis balls 8 which are collected by the cage 1 are guided into the ball channel 21 and then forced into the shooting box 3 by the blowing fan 4 through a connecting pipe 32. The upright support 22 can be turned horizontally, and therefore the horizontal shooting direction of the shooting box 3 can be adjsuted. By loosening the nut 24 from the pivot bolt 23, the tilt angle of the shooting box 3 on the machine base 2 can be adjusted. Therefore, the shooting angle of the pitching machine can be adjusted horizontally as well as vertically.

The shooting box 3 is covered with a top cover 35, comprising a storage chamber 31 near the back side thereof for keeping a certain number of stand-by table tennis balls 8, which has an input port connected to the ball channel 21 by the aforesaid connecting pipe 32 and an output port 311 disposed near the ball feeding mechanism 5, and a firing hole 32 on the front side thereof, through which table tennis balls 8 are driven out of the shooting box 3 one after another at a predetermined frequency. The storage chamber 31 comprises an upright wall 310 defining two arched slots 312 and 313 at two opposite sides, and a top cover 314 with a ventilation hole 3141 covered on the upright wall 310 at the top. The storage chamber 31 is designed to hold two or three table tennis balls 8.

Figure 2C:
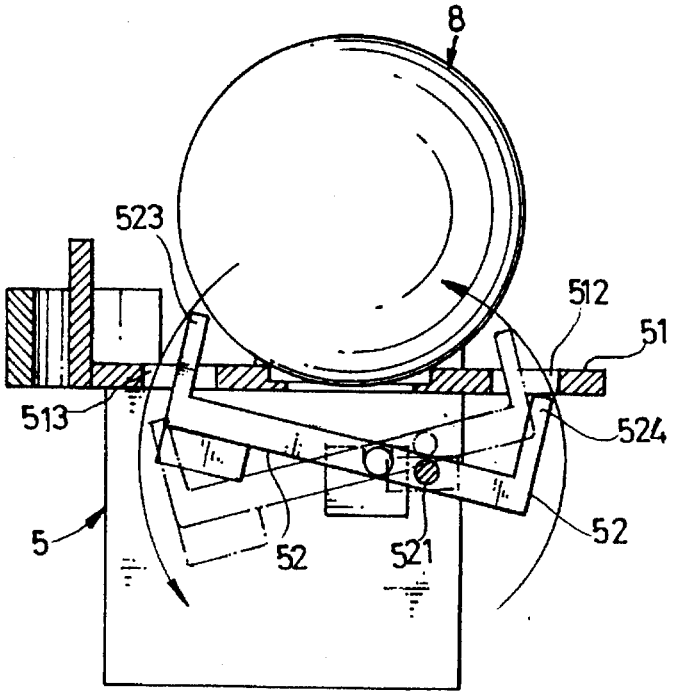
FIG. 2C is a partial view in an enlarged scale taken on FIG. 2A.
Figure 7:
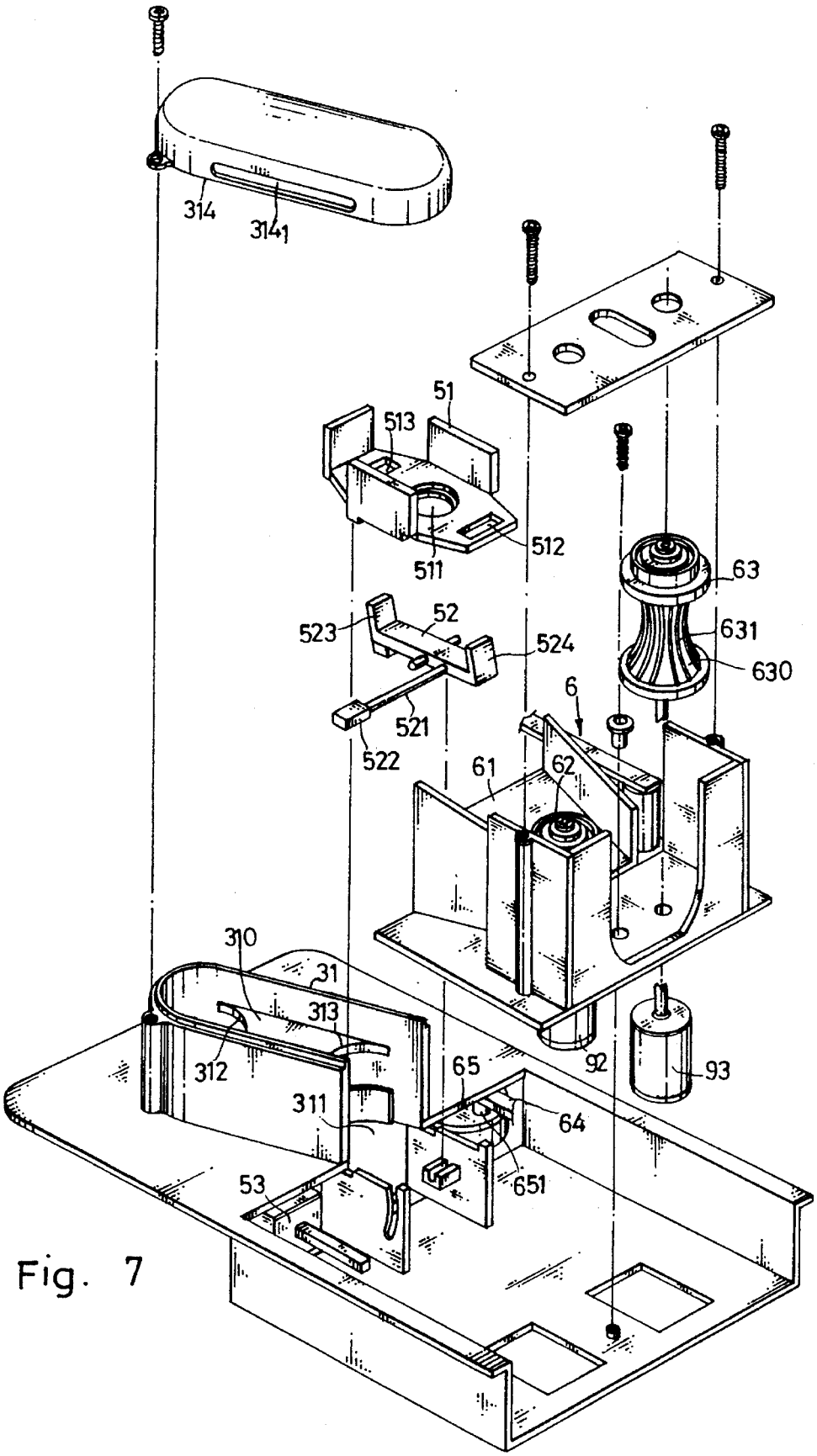
FIG. 7 is an exploded view of FIG. 6.
Figure 8:
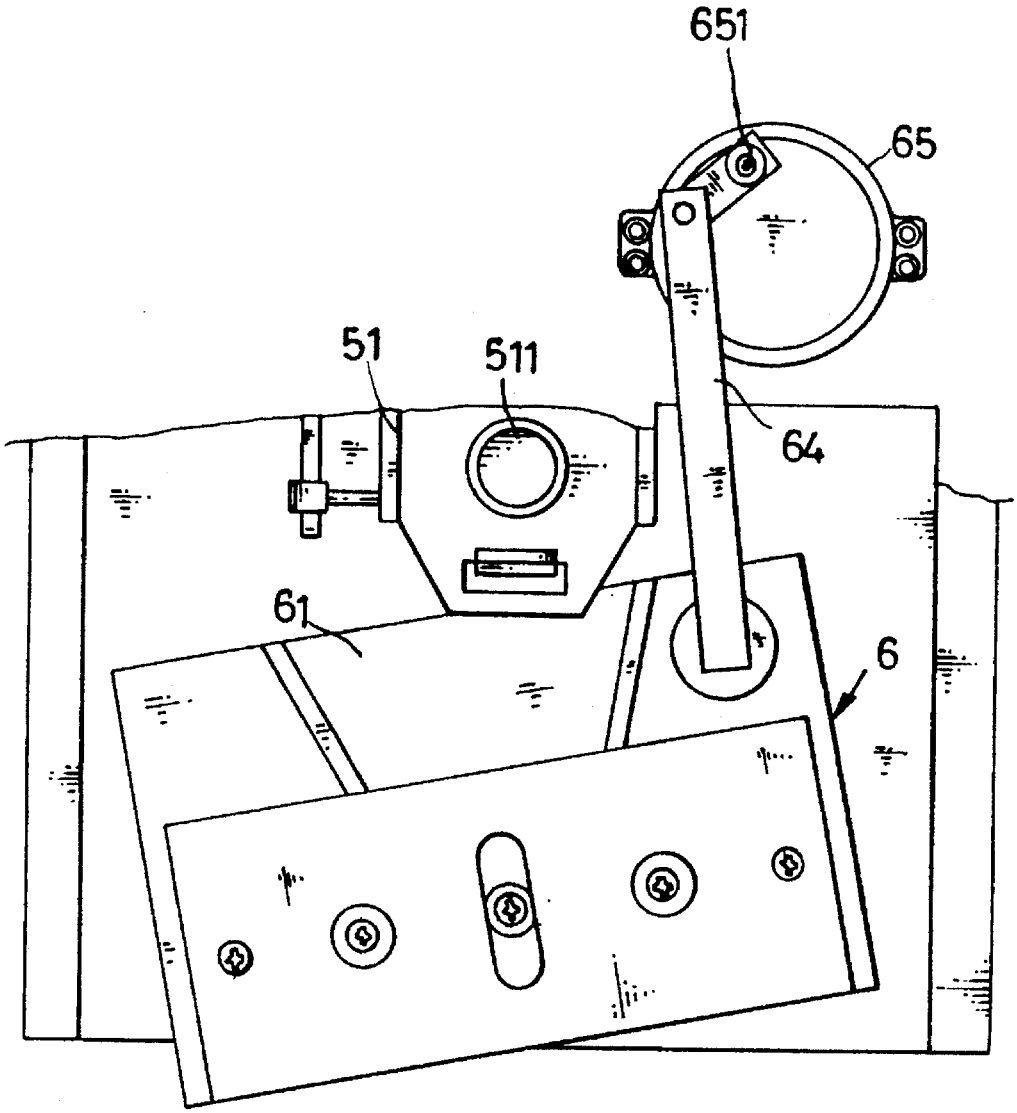
FIG. 8 is a plain view of the pitching mechanism according to the present invention.
Figure 9:
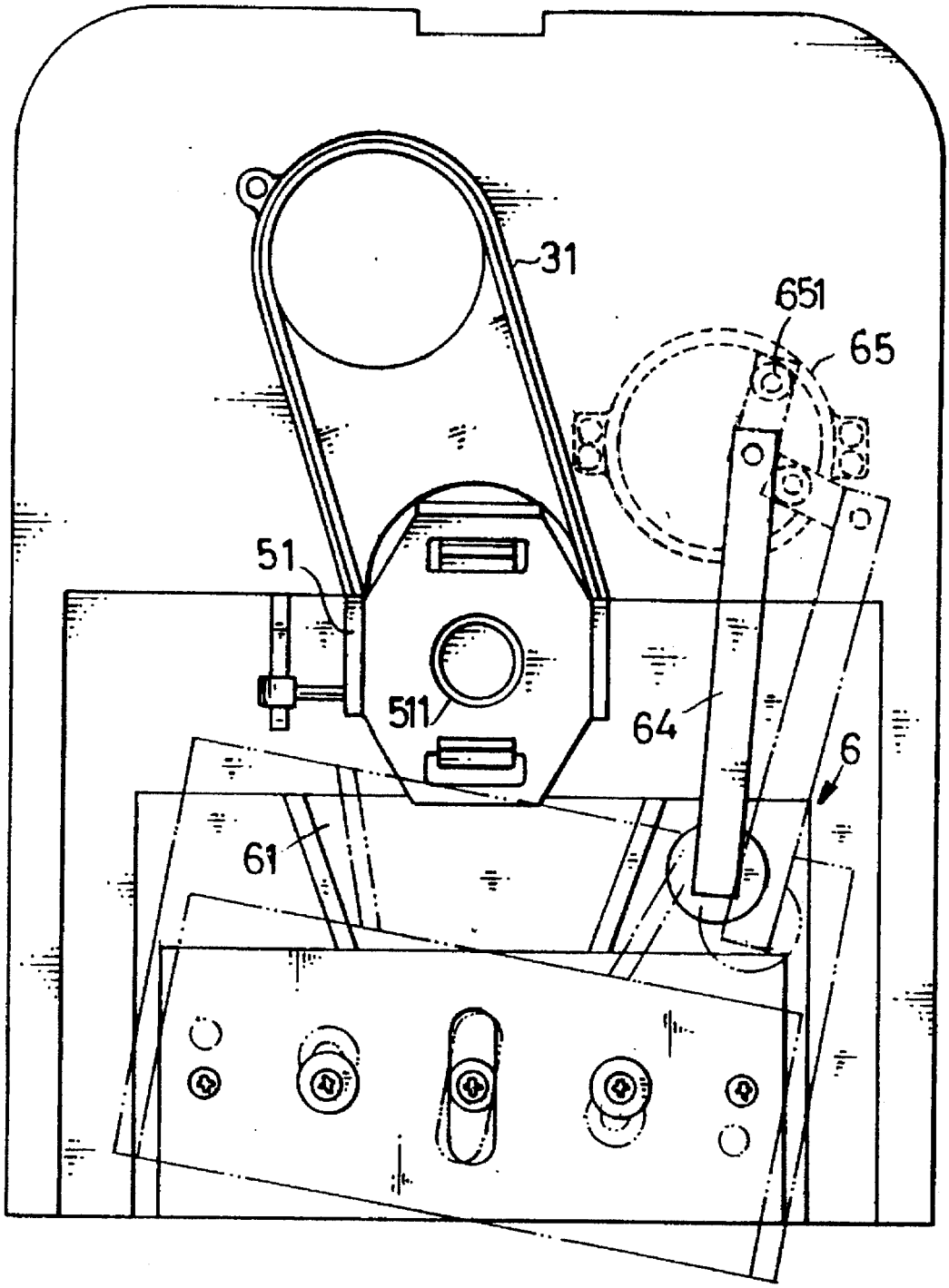
FIG. 9 shows the pitching mechanism of FIG. 8 moved by the reversible motor.

Referring to FIGS. 2C and 7 and FIG. 2A again, the ball feeding mechanism 5 comprises a receptacle 51 disposed adjacent to the output port 311 of the storage chamber 31, a rocker arm 52 disposed beneath the receptacle 51, and an electromagnetic device 53 controlled by the control circuit to operate intermittently. The receptacle 51 comprises a locating or retaining hole 511 at the center, which receives the table tennis ball 8, a first slot 512 and a second slot 513 at two opposite sides. The rocker arm 52 is pivotally mounted within the shooting box 3, having a first actuating rod 523 and a second actuating rod 524 at two opposite ends thereof and an extension rod 521 perpendicularly extended from one end thereof. The extension rod 521 is attached with a magnet 522. The first actuating rod 523 is heavier than the second actuating rod 524, therefore when the electromagnetic device 53 is inactive, the second actuating rod 524 is forced into the first slot 512 to stop the table tennis ball 8 in place. When the electromagnetic device 53 is energized or activated to attract the magnet 522, the rocker arm 52 is turned in one direction, causing the first actuating rod 523 to be inserted into the second slot 513 on the receptacle 51 for pushing the table tennis ball 8 away from the locating hole 511 of the receptacle 51 into the pitching mechanism 6.

Referring to FIGS. 2B, 6, 7, 8, and 9, the pitching mechanism 6 is linked to the eccentric shaft 651 of a reversible motor 65 by a link 64 and moved leftward or rightward, or stopped at any position within a fixed range, or paused at random. The pitching mechanism includes a slope 61 extended from the receptacle 51 for guiding the table tennis ball 8 from the locating hole 511 on the receptacle 51 into the firing position, two rotary members 62 and 63 are spaced behind the firing hole 33 and turned to throw the table tennis ball 8 from the slope 61 out of the shooting box 3, two unidirectional motors 92 and 93 are controlled to rotate the rotary members 62 and 63 causing the table tennis ball 8 to be thrown out of the shooting box 3 through the firing hole 33. The unidirectional motors 92 and 93 may be turned at different speeds or alternatively operated. The rotary members 62 and 63 are covered with a respective rubber covering 620 or 630. The rubber covering 620 or 630 has a plurality of longitudinal ribs 621 or 631 spaced around the outside wall. The longitudinal ribs 621 and 631 increase the friction force of the rotary members 62 and 63 against the table tennis ball 8. The curvature of the longitudinal oustide surface of the rubber covering 620 or 630 fits over the table tennis ball 8 so that the table tennis ball 8 can be thrown out of the firing hole 33 when it is guided into the gap between the rotary members 62 and 63.

The aforesaid control circuit controls the operation of the electromagnetic device 53 of the ball feeding mechanism 5, the reversible motor 65 and unidirectional motors 92 and 93 of the pitching mechanism 6. The control circuit is operated by means of the control of a set of control keys mounted on the control panel on the outside wall of the pitching box 3. The control circuit can also be controlled by an infrared remote-controller. A timer may be installed and connected to the control circuit so that the user can set the desired training time.

When table tennis balls 8 are guided into the ball channels 21 through the ball inlet 211, they are blown into the storage chamber 31 in proper order by the blowing fan 4. When the first table tennis ball 8 is moved to the receptable 51, the electromagnetic device 53 is energized to move the rocker arm 52 causing the table tennis ball 8 to be pushed away from the receptacle 51 and guided onto slope 61 and then driven out of the pitching box 3 throught the firing hole 33 by the rotary members 62 and 63 of the pitching mechanism 6. A fireball is performed when the rotary members 62 and 63 are simultaneously turned at the same high speed. A breaking pitch is performed when the rotary members 62 and 63 are turned at different speeds or when only one rotary member 62 or 63 is turned.

I claim:

1. A table tennis training system comprising a pitching machine for throwing table tennis balls one after another toward a player at a predetermined frequency, and a cage disposed around said pitching machine for collecting table tennis balls and automatically guiding table tennis balls into said pitching machine, said pitching machine comprising:

a machine base having a top opening and a bottom, a vertical ball channel extending downward from said top opening, a ball inlet for receiving table tennis balls from said cage and for guiding table tennis balls into said ball channel, and a blowing fan installed in said bottom of said machine base and in said vertical ball channel for blowing table tennis balls contained in said vertical ball channel through said vertical ball channel and out of said top opening of said machine base;

a shooting box mounted above and on said machine base, said shooting box having a ball feeding mechanism, a pitching mechanism, a storage chamber with an input port and an output port, a front side with a firing hole, and a connecting pipe connecting said top opening of said machine base to said input port; and supporting structure arranged between said machine base and said shooting box for supporting said shooting box and permitting movement of said shooting box horizontally and vertically relative to said machine base;

said ball feeding mechanism for receiving table tennis balls from said storage chamber and transporting table tennis balls to a firing position, said ball feeding mechanism including a receptacle connected to said output port of said storage chamber, an electromagnetic device, and a rocker arm controlled by said electromagnetic device for pushing a table tennis ball out of said receptacle into said firing position; said receptacle comprising a first end with a first slot, a second end with a second slot and a center with a retaining hole, said retaining hole receiving a table tennis ball from said storage chamber; said rocker including a first end with a first actuating rod, a second end with a second actuating rod, and an extension rod with a magnet perpendicularly extending from said second end thereof; said second actuating rod received in said first slot of said receptacle for holding a table tennis ball in said retaining hole of said receptacle when said electromagnetic device is inactive, and said first actuating rod entering said second slot of said receptacle for forcing the table tennis ball out of said retaining hole of said receptacle into said firing position when said electromagnetic device is activated and attracts said magnet of said extension rod; and said pitching mechanism including a reversible motor, an eccentric shaft and a link connecting said motor and said eccentric shaft for moving said eccentric shaft between a left limit position and a right limit position and throwing a table tennis ball from said firing position out of said firing hole of said shooting box, said pitching mechanism further including a slope for guiding a table tennis ball from said receptacle to said firing position, two rotary members disposed at opposite sides of said firing position, and two unidirectional motors for rotating said rotary members and throwing a table tennis ball from said firing position out of said firing hole, said rotary members respectively covered with a rubber coveting having a plurality of longitudinal ribs;

wherein said electromagnetic device is intermittently activated at a predetermined frequency for periodically supplying a tennis ball to said pitching mechanism, said pitching mechanism is moved to any position between said left and right limited positions, and said unidirectional motors are rotated simultaneously or alternatively at same or different speeds for throwing a table tennis ball out of said firing hole.

2. The table tennis training system of claim 1, wherein said storage chamber includes an upright wall with two arched slots at opposite ends thereof, and a top cover with a ventilation hole mounted on said upright wall.

* * * * *